US005597234A

United States Patent [19]

Winkelhake

[11] Patent Number: 5,597,234

[45] Date of Patent: Jan. 28, 1997

[54] TRIM RETAINER

[75] Inventor: William Winkelhake, Hoffman Estates, Ill.

[73] Assignee: Cooper Industries, Inc., Houston, Tex.

[21] Appl. No.: 237,019

[22] Filed: May 2, 1994

[51] Int. Cl.[6] ..... F21S 1/06

[52] U.S. Cl. ..... 362/364; 362/365; 362/375

[58] Field of Search ..... 362/147, 280, 362/306, 364, 365, 375, 433, 440, 453, 454, 455; 248/320, 343

[56] References Cited

U.S. PATENT DOCUMENTS

| | | | |
|---|---|---|---|
| 1,048,983 | 12/1912 | Madden | 362/375 |
| 3,313,931 | 4/1967 | Klugman | 362/364 |
| 3,328,579 | 6/1967 | Green | 362/375 |
| 3,370,165 | 2/1968 | Chan | 362/364 |
| 3,744,396 | 7/1973 | Raider | 362/364 |

*Primary Examiner*—Y. My Quach

*Attorney, Agent, or Firm*—Burns, Doane, Swecker & Mathis, L.L.P.

[57] ABSTRACT

A trim-ring auxiliary member system for capturing and supporting an auxiliary member relative to an interior and an open end or a lighting housing. The housing includes an annular groove formed in an interior of the housing. The groove is axially spaced from an open end of the housing. A support spring member is removably secured to the interior of the housing and disposed within and retained by the groove. A connecting spring removably attaches the auxiliary member to the support spring member.

18 Claims, 13 Drawing Sheets

114
115

132
134
126
130
128

8A
52b
140
136
131
114
136
134
132
50b
128
54b
126
128
130
8A
114

13C
13C
126d 160
50d 162
160

162
160

13A
128d
126d
136d
132d
13A
13B
13B
14
14

TRIM RETAINER

BACKGROUND OF THE INVENTION

FIELD OF THE INVENTION

The invention relates to a trim-ring auxiliary member system having a lighting housing and a supporting spring member. Lighting fixtures of the recessed or track variety, generally include a cylindrical can-like housing for enclosing the light source, the socket, wiring, baffle or reflector, and trim means for decoratively covering the open end of the can.

In most of such housings, portions of the sheet metal walls are punched out and deflected inwardly forming lugs, or auxiliary brackets are welded to the inside of the housing, to support such baffles, trim-ring means or other assembly means. Such lugs, or brackets, generally have extremely sharp burr edges. For two such examples, in the patent issued to Lester Gilman, U.S. Pat. No. 4,336,575, see lugs 62, and in the patent issued to Earl F. Miles, Jr., U.S. Pat. No. 3,660,651, see mounting 68 welded to the interior wall and projecting inwardly from housing 21. Such lugs are rigidly fixed to the wall of the can-like housing and unless there are a plurality of axially spaced lugs there is little or no choice in the selection of support means.

The means used for fastening the trim rings or other means to such lugs generally are well known and may be either torsion springs such as spring 99 in the patent to Miles, set forth above, or tension springs (not shown) described in Column 3, lines 26–29, in the patent to Gilman, set forth above. In each instance, it is necessary for the installer to insert his hands into the interior of the can to install the secondary retaining spring members and thereby expose his hands to the sharp burrs on the edges of the sheet metal lugs used to support the retaining spring members.

BRIEF DESCRIPTION OF INVENTION

This invention relates to an improved lighting fixture of the type which may use a trim-ring connected to the bottom of a lighting fixture housing can and is applicable to lighting fixtures of either the recessed variety or of the track variety.

It is a primary object of the present invention to provide an improved trim ring and baffle mounting system for a simplified assembly and retention system for such aesthetic auxiliary items.

It is a further object of the present invention to provide an internal support system for the housing of a can-type lighting fixture that is simple in construction and can be assembled rapidly at the point of installation.

Another object of the present invention is to provide either a recessed or a track type of lighting fixture having internal support means, for retention of a trim ring or deflector means, which can be adjusted axially to a plurality of positions in a simple and effective manner without the use of external fastening means such as screws and without the problem of confronting sharp burr-like edges of sheet metal projecting into the interior of the can-like housing.

Still another object of the present invention is to provide a lighting fixture housing that has a substantially smooth interior wall, portions of the wall having at least one annular concave groove opening inwardly in axially spaced transverse planar relation from the open end of the can and a retaining spring means having complimentary engaging means of such a configuration that a substantial portion of the engaging means of the spring may be positioned Within said groove and thereby axially retained.

An additional novel element resides in the configuration of the retaining spring means in combination with the wall groove in the housing interior wall.

A further feature, in another embodiment, is the provision of at least one aperture opening outwardly through said at least one annular groove and said spring means including a complimentary element for engaging said aperture, engagement of said spring with said groove provides an axial restraint while engagement by said complimentary element in said aperture provides a rotational restraint as well as giving said spring a positive orientation.

Another feature of the present invention is to provide a lighting housing can having a generally smooth interior wall except for at least one substantially continuous annular concave groove opening inwardly and disposed in a plane generally perpendicular to the axis of the can. The groove has a predetermined diameter larger than the diameter of the can, while the spring in its relaxed state is greater than the diameter of the can and is at least equal to the predetermined diameter of the groove. The spring preferably is slightly greater in diameter than the groove so that it is constantly exerting an outwardly directed force and hence to retain itself within the groove when so oriented.

Still another object of the present invention is to provide variations to the above stated objects, for example, to provide a discontinuous or interrupted groove having segments peripherally spaced in a common plane about the interior of the can and a spring including peripherally spaced portions complimentary to the spaced groove segments and adapted to maintain its location substantially perpendicular to the axis of the can. The spring defining substantially smooth bridge means extending inwardly into the can and adapted to accept the generally axially extending secondary spring means used for retention of baffles and trim-rings.

A further object of the present invention is to provide a smooth lighting housing can except for a plurality of circumferentially spaced planar oriented apertures and an annular spring member having a plurality of laterally extending portions for complimentary engagement with a plurality of said apertures. Such an arrangement can also include a substantially planar disc-like member moveably captured relative to the spring member. The spring member is discontinuous and provided with gripping means at its free ends, whereby squeezing said gripping means together reduces the overall diametral size of the spring and thereby permits movement relative to said housing can.

DETAILED DESCRIPTION OF THE INVENTION

Figure 1:
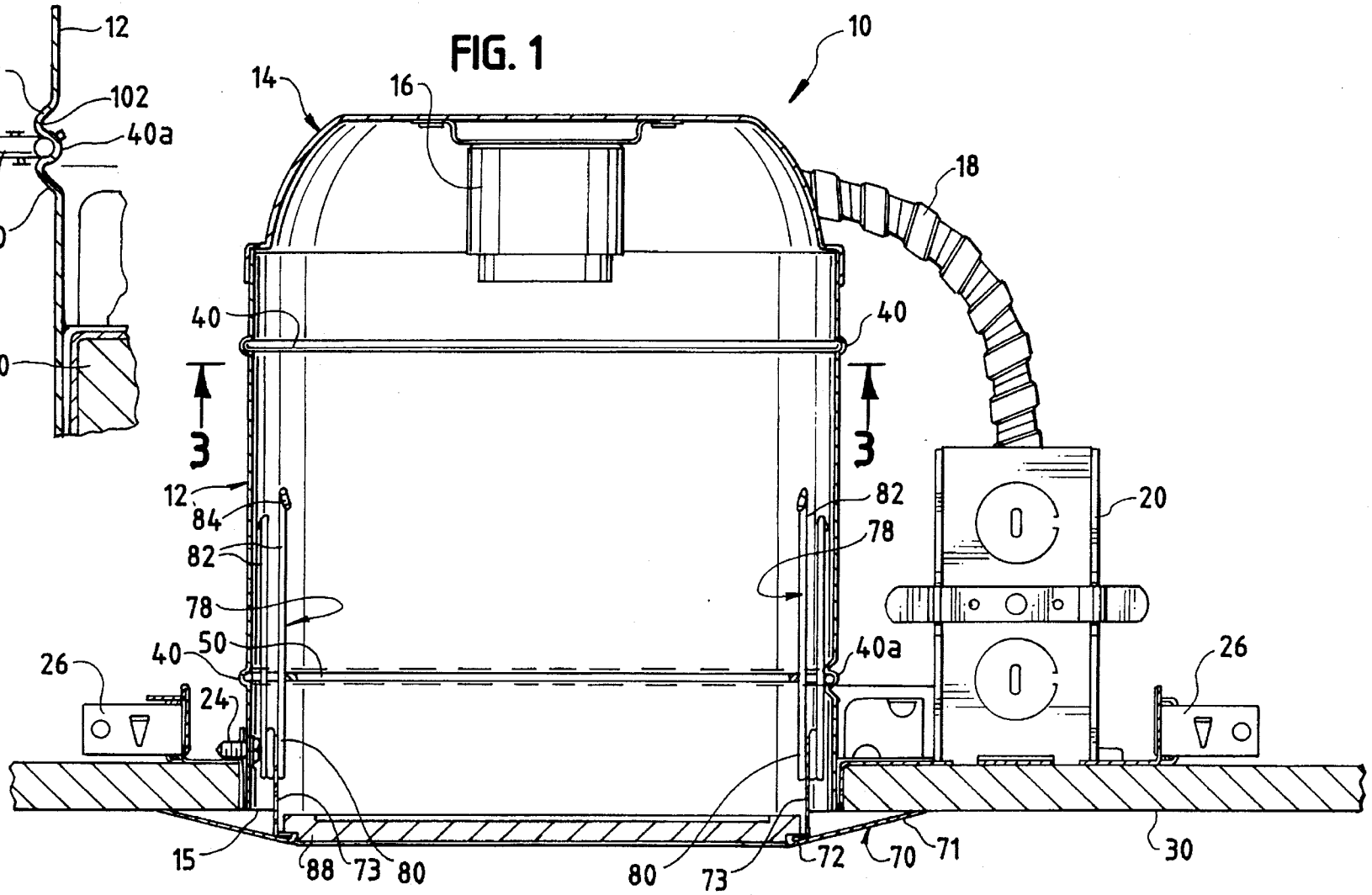
FIG. 1 is an elevational view in partial section of one embodiment of the present invention.
Figure 3:
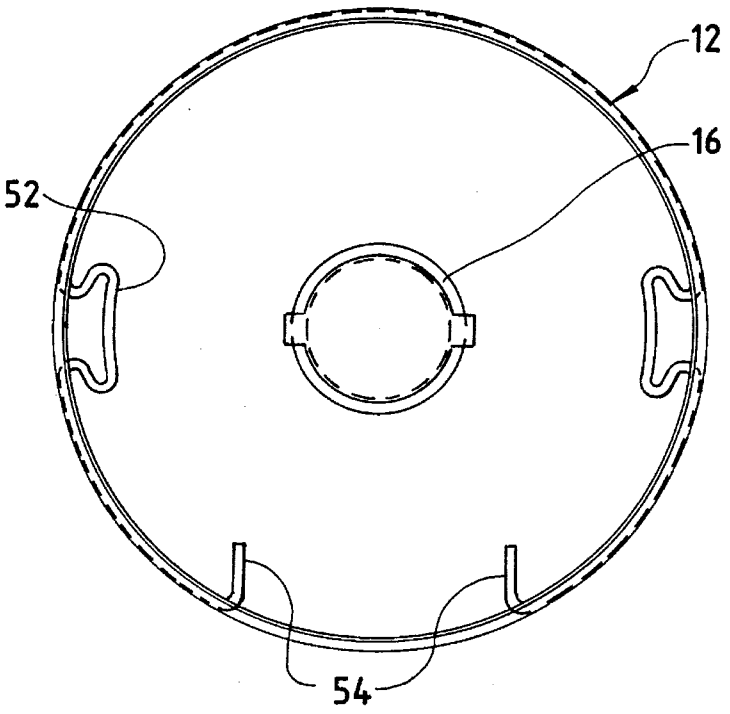
FIG. 3 is a sectional view taken generally along line 3—3 of FIG. 1 showing the spring member of FIG. 2 positioned within a can groove.
Figure 2:
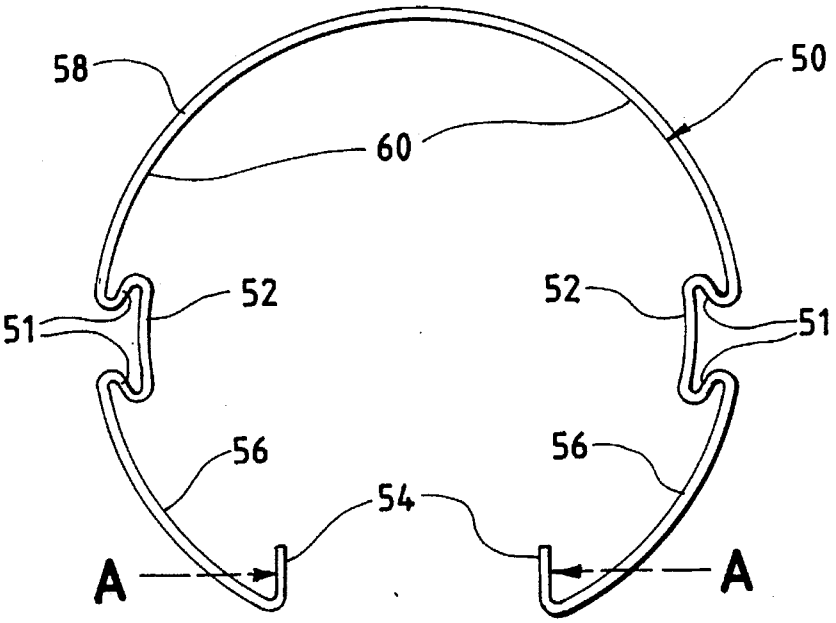
FIG. 2 is a plan view of one form of the main support spring element of the present invention.

Referring now to the drawing wherein similar parts are designated by similar numerals, and particularly FIGS. 1 through 3, a lighting fixture 10 of the type contemplated by the present invention may include a can-like body or housing 12, closed at one end by an end cap or top 14 and open at the opposite end 15.

Figure 4:
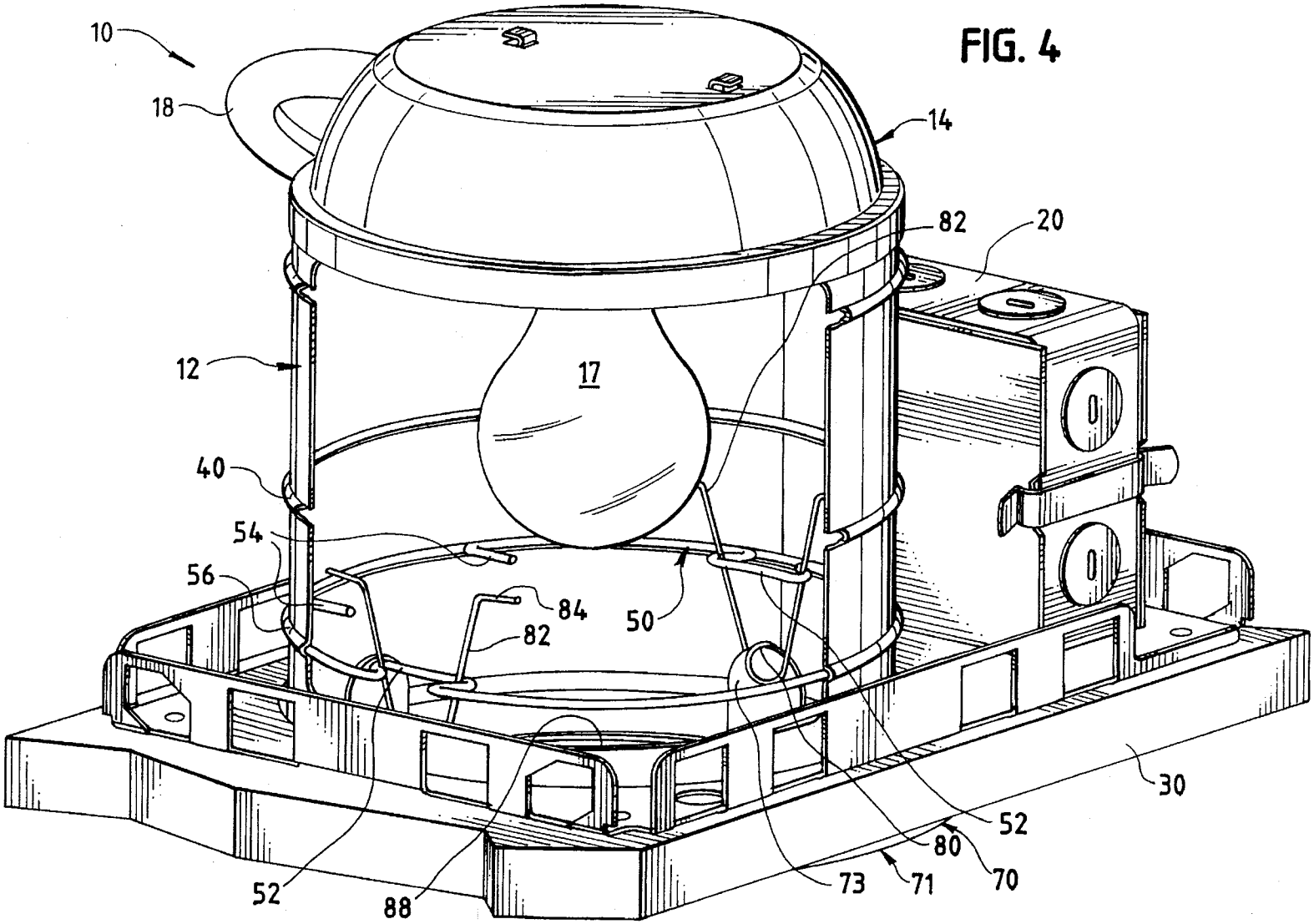
FIG. 4 is a perspective view in partial section of the first embodiment of the present invention shown in FIGS. 1–3 with the light socket supported by the housing endcap.

A socket 16, for accepting a light source 17, not shown for clarity in FIG. 1 but shown in FIG. 4, is provided in the interior of the housing 12 and may be adjustable or fixed, as is well known in the art, in differing axial positions. Suitable insulated power connection means 18 extends between the socket 16 and a junction box 20 for connection to the power source, not shown, as is also well known in the art. Screws 24 and at least one hangar bar 26, as are known in the art, serve to mount the housing 12 relative to the opening in the wall or ceiling 30. In the case of track lighting, the support means extending from the track generally is fixed to the end cap 14 or the housing 12 and normally will also accommodate the power connection, however, the following housing and trim-ring description is applicable to both types of lighting fixtures.

The illustrated sheet-metal housing 12 is generally a roll-formed can-like configuration, however, the housing can be roll-formed, die cast, injection molded or deep drawn to meet the requirements of a particular installation. In accordance with the system of this invention, the housing when roll-formed can include at least one concave semi-toroidal annular groove 40 arranged in a planar array perpendicular to the axis of the housing. Such grooves 40 have a predetermined diametral spacing as measured from the root of a groove on one side of the axis of the housing 12 to the root of the groove diametrically opposed on the other side of the axis of the housing. Preferably there will be a plurality of annular grooves 40 axially spaced along the axis of the housing 12. Such grooves 40 are smooth to the feel and do not injure the hands of the installers.

The complimentary part of this system is a discontinuous or interrupted ring-like supporting spring member 50 having a diameter at least as large and preferably slightly larger than the predetermined diametral spacing of the grooves 40. The supporting spring members 50 each include a pair of radially inwardly projecting bridge-like rod means each having a projection bar 52 and supporting spring legs 51, for purposes set forth hereinafter, and a pair of inwardly directed handle means 54. When an opposing pressure "A", as indicated by the arrows "A", is applied to the handle means 54 the spring will deflect and cause the portion 58 to bend slightly causing segments 56 and 60 to approach one another and reducing the diametral measurement thereof, thereby permitting insertion of the spring 50 into the interior of the housing 12 and insertion of the spring 50 into engagement with one of the grooves 40. As can be seen the spring 50 is really an interrupted member, as for example the spacing created by the material comprising the configuration of inwardly projecting bar 52 and supporting spring legs 51 as well as the gap between and disconnected spacing of the handles 54. Hence it is the circumferentially spaced portions 56, 58, and 60 that are seated in and contact the groove 40 in peripherally spaced locations. Thus, this invention is also meant to contemplate a housing device, not shown, which would have a discontinuous groove that was complimentary to and capable of accommodating the spaced portions of the spring, as long as the spring was generally maintained in a planar position perpendicular to the axis of the housing 12.

It will be seen that the spring 50 can be positioned in any one of a plurality of axially spaced grooves 40. As seen in FIG. 4 the spring 50 is positioned in the lowermost groove 40 to accommodate a connecting torsion spring 78 supporting a trim ring 70 having lateral spring-like flange 71, an internal fold-over flange 72 and at least two upward extending tabs 73 adapted to be accepted within the torsion rings 80 of spring 78 terminating in a pair of spread arms 82 with a flange or hook 84 at their extremities. The torsion spring 78 arms 82 are squeezed together so that the hooks 84 can be introduced into the bridge-like rod means with the angular spring arms 82 pressing against the inner extensions 51. The spring 78 insures tight positioning of the ring 70 against the wall or ceiling 30 as well as to insure prevention of ambient vibrations from causing a rattling condition. If desired, the inwardly directed flange 72 can serve to support a flanged lens 88 closing the end 15 of the housing 12.

As seen in FIGS. 2 and 4 the spring 50 includes the reversely bent extensions 51 that support bars 52. When spring 50 is inserted into a groove 40 it forms a generally elongated cage defined by extensions 51, bar 52 and the housing 12. This is ideally suited to accept the hooked-end arms 82 of the connecting torsion spring 78. In this embodiment, the spring 78 is mounted on the free end of a flat tab 73 having a laterally extending trim-ring 70.

Figure 1A:
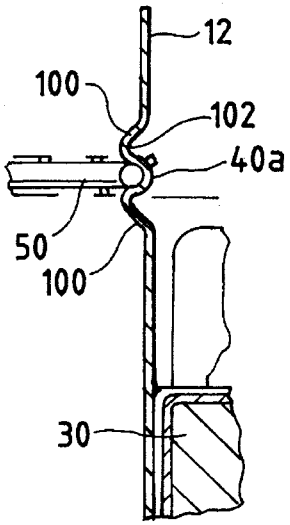
FIG. 1A is an enlarged partial sectional view of an alternate configuration of a double bead groove for use on any substantially flat side of the interior of the can.

In some instances it may be desirable to keep the housing 12 substantially constant in external diameter for aesthetics or for dimensional reasons necessary for installation. In such circumstances it may be undesirable to have the semi-toroidal body forming groove 40 projecting outwardly from the surface of the housing. In such cases it is possible to provide an annular double bead in the form of a pair of inwardly directed walls 100, as best seen in exploded view in FIG. 1A, forming a pair of axially spaced concavely outwardly extending grooves 102 that open outwardly and between grooves 102 support an inwardly opening groove 40*a* whose outwardly directed convex shell does not extend outwardly beyond the theoretical envelope of the housing 12.

Figure 4A:
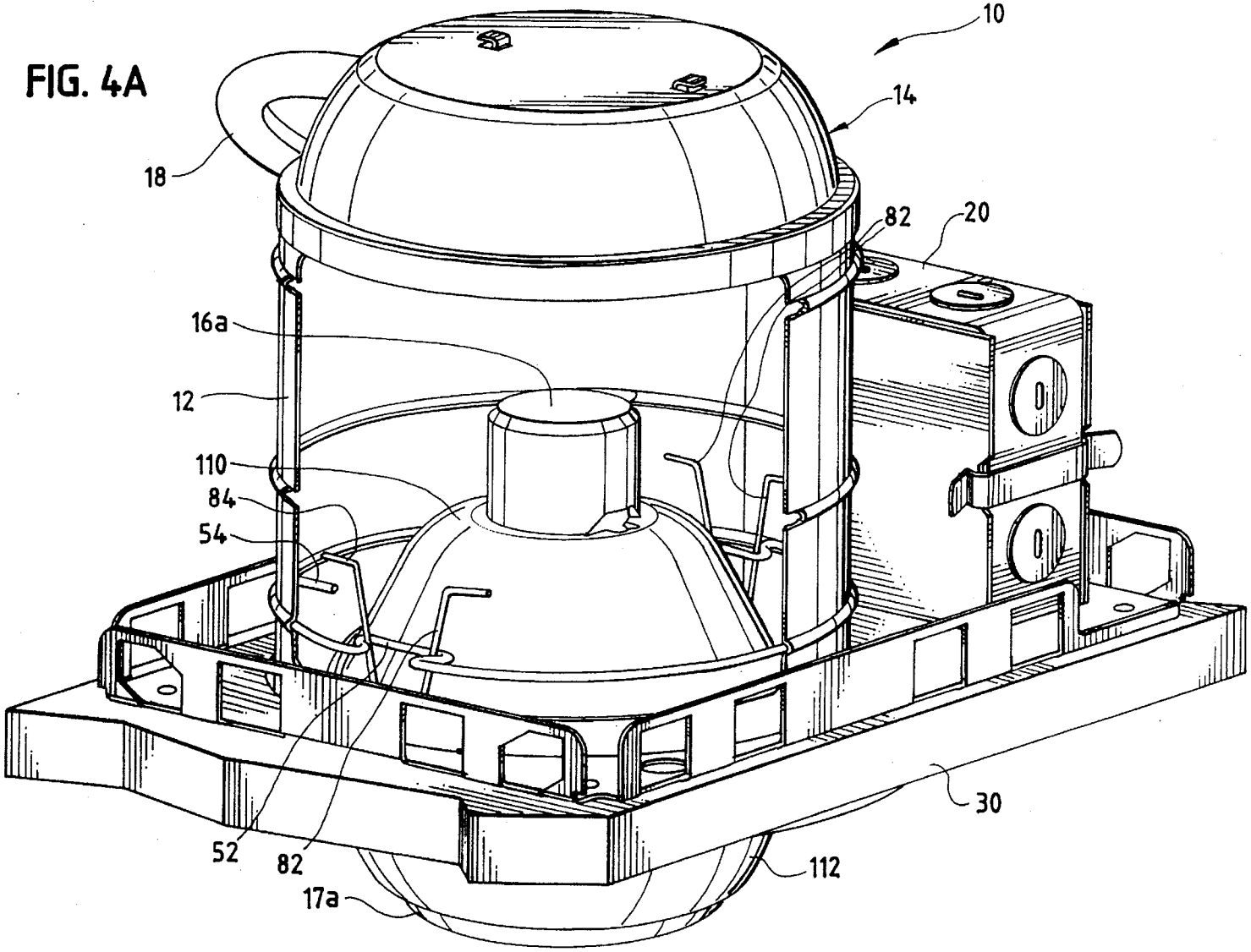
FIG. 4A is a perspective view in partial section of the first embodiment of the present invention shown in FIG. 4 but with the light socket axially displaced downwardly and supported by spring means rather than the endcap of the housing.

A modification to the first embodiment can be seen in FIG. 4A, basically the same envelope shown in FIG. 4, except wherein the socket 16*a* is not supported by the endcap 14, but rather, is supported by a secondary shroud 110 that is connected and supported by the torsion springs' arms 82 engagement with the bridges 52. A secondary portion 112 of the shroud encases the lamp 17*a* in protective array. (The socket 16*a* connection with the power means 18 is not shown for clarity in illustration of the present invention).

Referring now to the next embodiment best seen in FIGS. 5–9, wherein similar parts are referred to by similar numerals and variations identified with the suffix "b".

In this embodiment the spring 50*b* includes a plurality of outwardly extending circumferentially spaced protruberances or loops 114 which are substantially equal in number to complimentary slots 115 which are located in the wall of housing 12. The slots can either be independently arranged in circumferentially spaced planar array or alternatively can be located in the root of one of the grooves 40. As can be appreciated, the spring 50 and grooves 40 provide an axial restraining system, while the slots 115 and loops 114 provide both an axial as well as a rotational restraining system. Such a spring 50*b* can be utilized in a multiplicity of locations within the housing and is limited only by the number and spacing of grooves within the housing 12 or, alternatively, the number and spacing of slots 115. In one form of the modified spring 50*b*, seen in FIGS. 5 and 7, the spring 50*b* includes a plurality of laterally extending loops or protuberances 114 that are accepted in complimentary slots 115 located in the roots of grooves 40. A tension spring member 118 having connective means 117 and 119 at opposite ends thereof is connected by means 119 at one end to the bridge 52*b* and at the opposite end connected by means 117 to aperture 121 at the minor end of baffle 120. The open end of baffle 120 has a laterally extending flange 122 adapted to mate with and support trim ring 124 serving to provide an aesthetic closure for open end 15 of housing 12.

Figure 5:
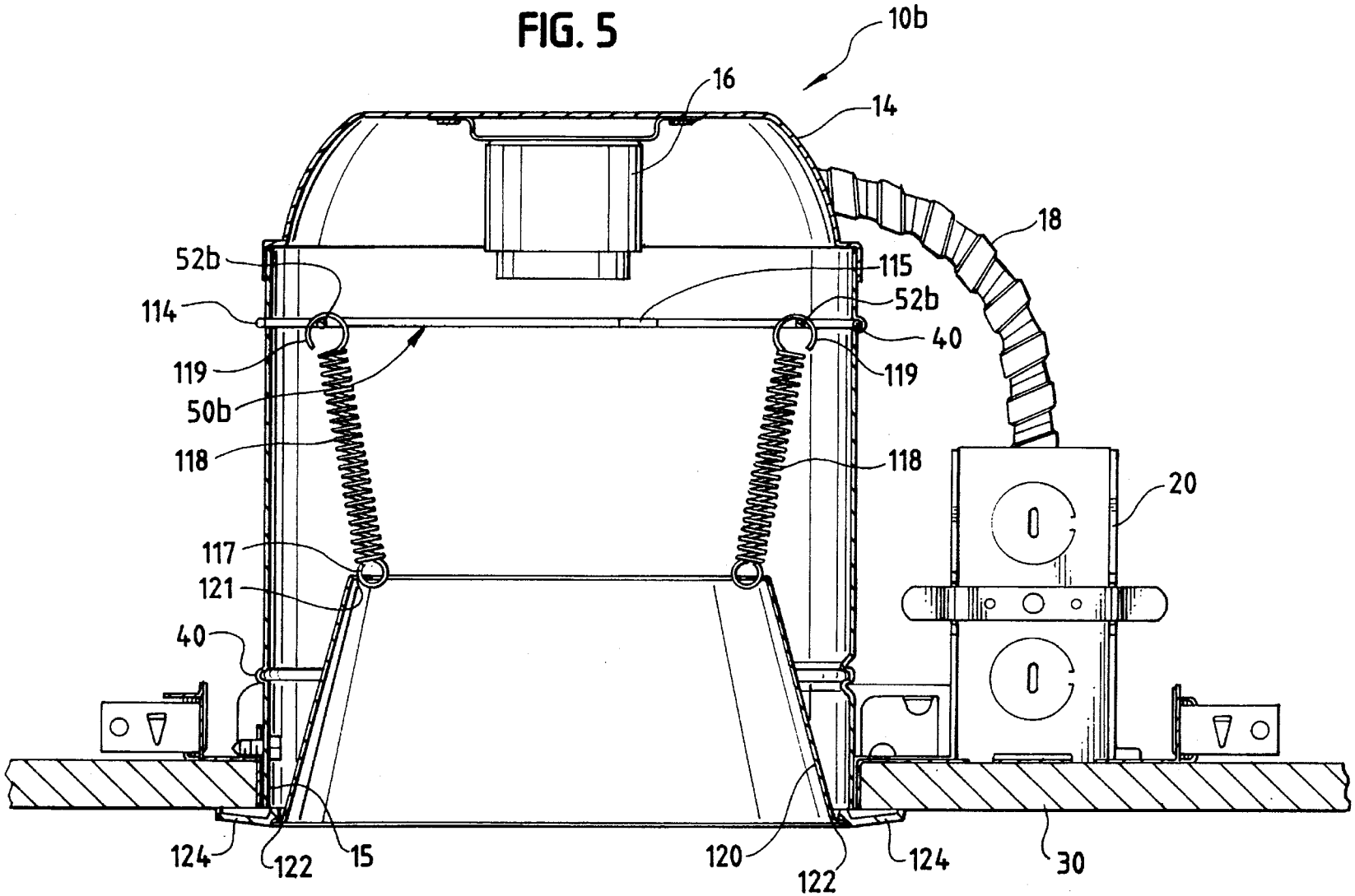
FIG. 5 is a sectional view of the embodiment shown in FIG. 1 modified with a reflector element supporting a trim element, both elements being supported by at least one tension spring, shown in installed position.
Figures 8, 8A, 8B:
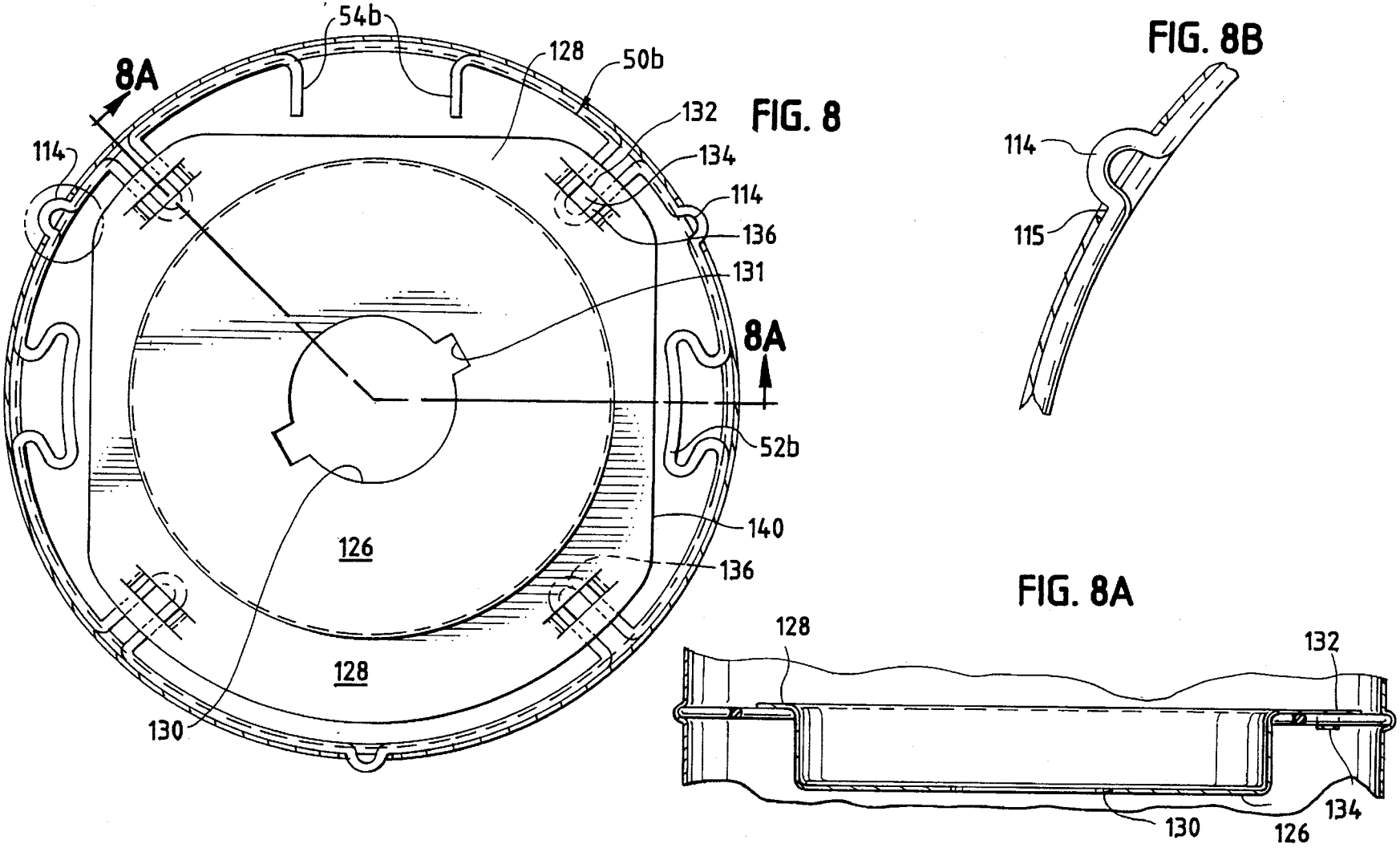
FIG. 8 is a further variation in the spring element which includes the bridge means for accepting secondary spring mounting means, externally projecting loops or protuberances for engagement with complimentary apertures in the can and additionally includes inwardly directed loops for capture in a planar flange means which in this embodiment is integral with an apertured cup-like member.
FIG. 8A is a sectional elevation taken along line 8A—8A in FIG. 8.
FIG. 8B is an exploded partial view of a spring loop traversing an aperture in the bottom of a groove with the spring seated in said groove.
Figure 9:
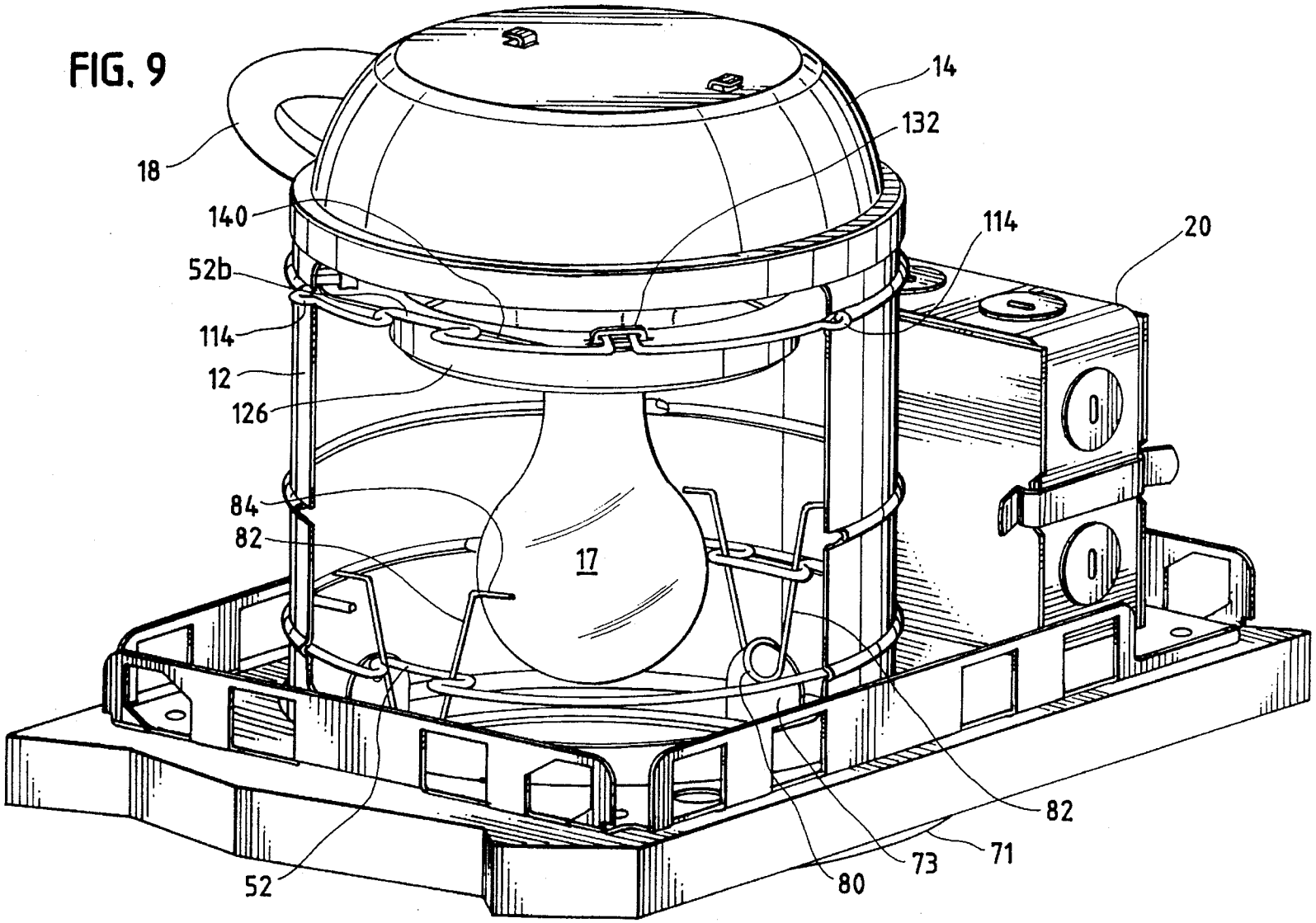
FIG. 9 is a perspective view in partial section of an embodiment utilizing the teachings of FIG. 8 in the upper groove of the illustrated can.
Figure 10A:
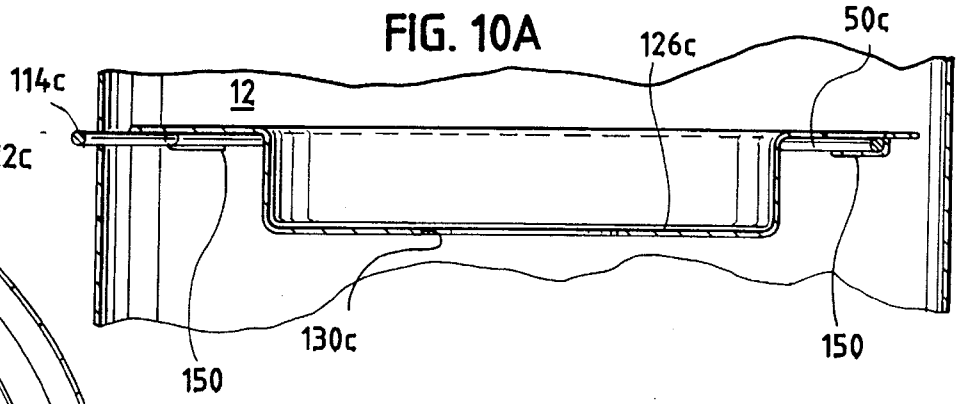
FIG. 10A is a transverse section taken along line 10A—10A showing the loops of the spring traversing the apertures in the can wall and retained by struck out tabs to the planar flange member.

A variation on this embodiment can be found in FIGS. 5, 8 and 9, wherein the spring 50*b* is captured by and supports a polygonal shaped planar member 128 integral with a shallow cuplike element 126. The planar member 128 is lanced at a plurality of circumferentially spaced portions as at 132 to form a strap 134 spaced from 128 to accept one of a plurality of radially inwardly directed elements 136 of spring 50*b*. The lanced portions 132 have an extent adequate to permit some lateral movement by elements 136 when handles 54*b* are squeezed together for adjustment or replacement of the spring 50*b* relative to the housing 12. The planar member 128 includes a segment 140 which is relieved and substantially spaced from the bridge 52*b* to permit access to the bridge for attachment of supporting means such as tension springs 118 or torsion springs 78. The cup-like member 126 is centrally apertured as at 130 and provided with key-hole slots 131 for accepting dogs on sockets (not shown) by rotational assembly.

Figure 6:
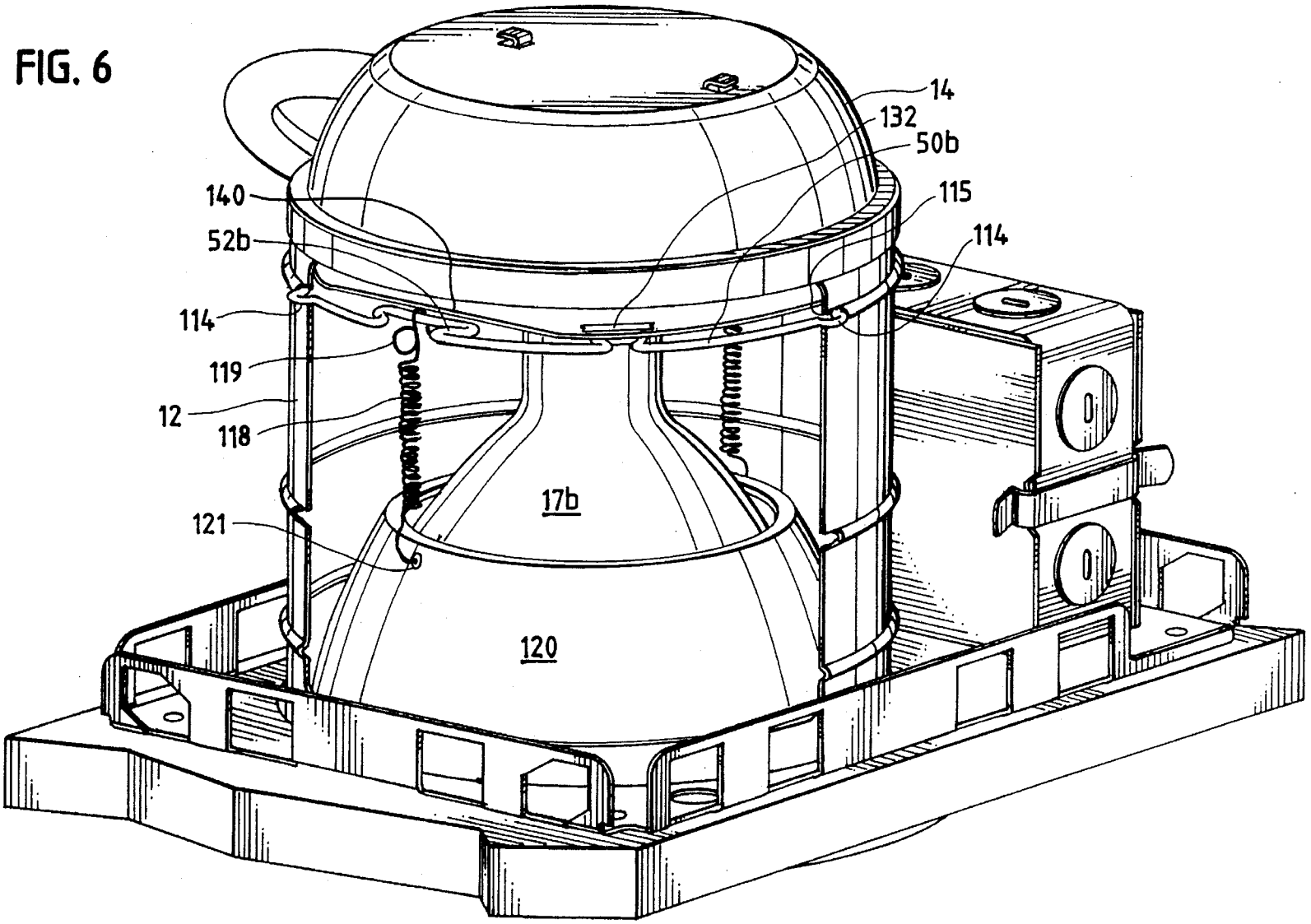
FIG. 6 is a perspective view in partial section of the embodiment shown in FIG. 5.
Figure 7:
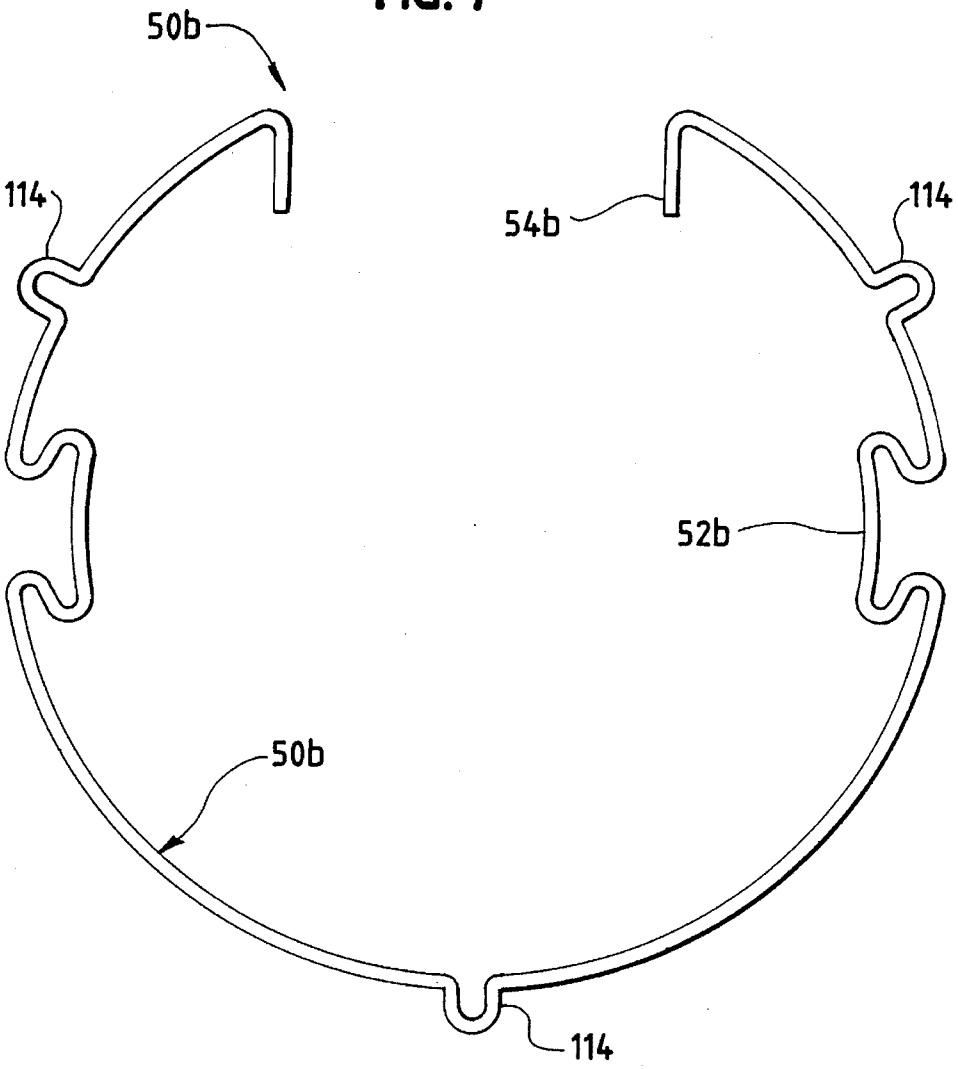
FIG. 7 is a plan view of another embodiment, namely, the spring element used in FIG. 6, having the same spring supporting bridge elements of the prior embodiment but additionally having outwardly projecting loops or protuberances for complimentary engagement with a plurality of circumferentially spaced apertures or slots in planar array which can be disposed in the wall of the housing or in the root of the groove.

FIG. 6 discloses in perspective relation a long neck flood or spot lamp having the socket means supported by the endcap 14 and the baffle 120 supported by at least two springs 118 connected to the upper groove and slot means for accepting the spring 50*b*. FIG. 9, on the other hand, discloses a more normal short neck bulb 17 accepted in a socket held in the flat cup-like member 126 which is part of the assembly shown in FIG. 8.

Figure 11:
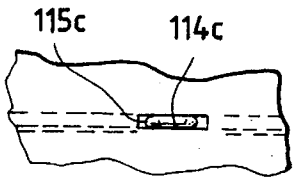
FIG. 11 is fragmented view taken along line 11—11 showing the loop of the spring projecting outwardly of a slot in the can wall.
Figure 10:
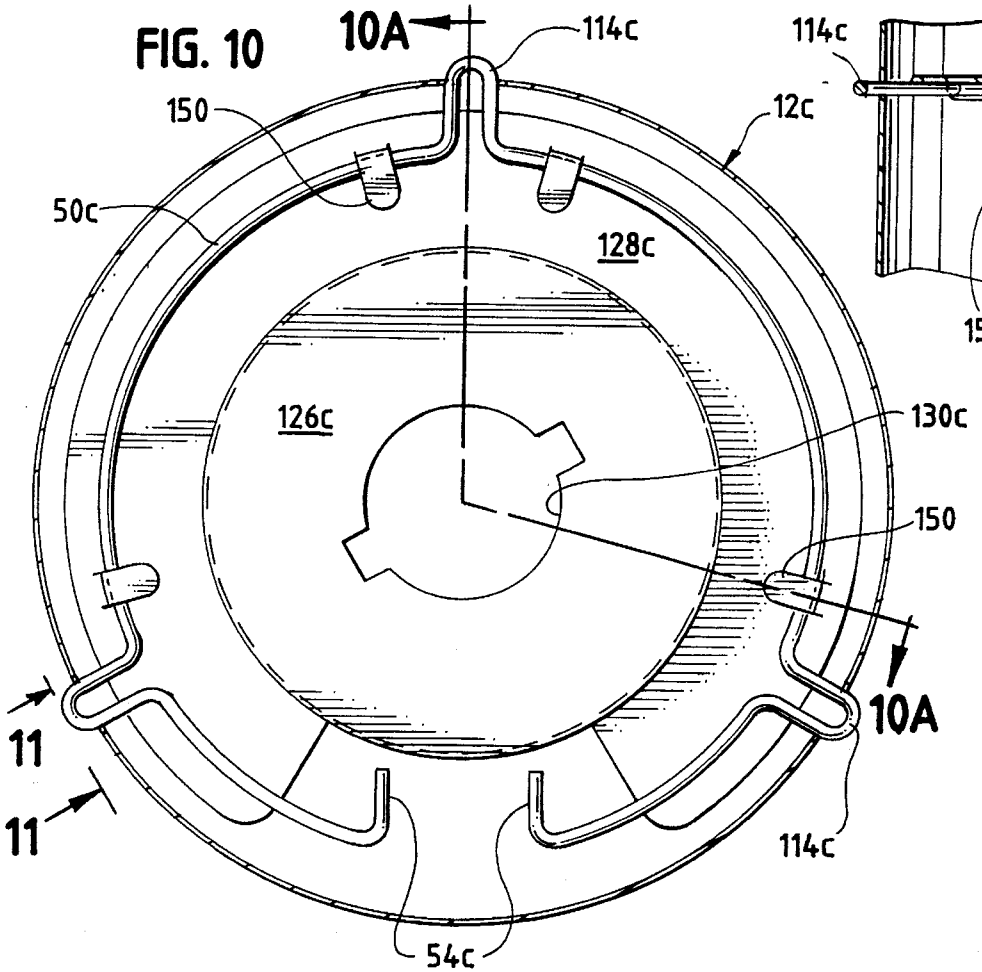
FIG. 10 is a plan view in partial section of still another embodiment of spring member moveably captured by struck out tabs in a planar flange member encircling and integral with an apertured generally flat cup shaped member.
Figure 12:
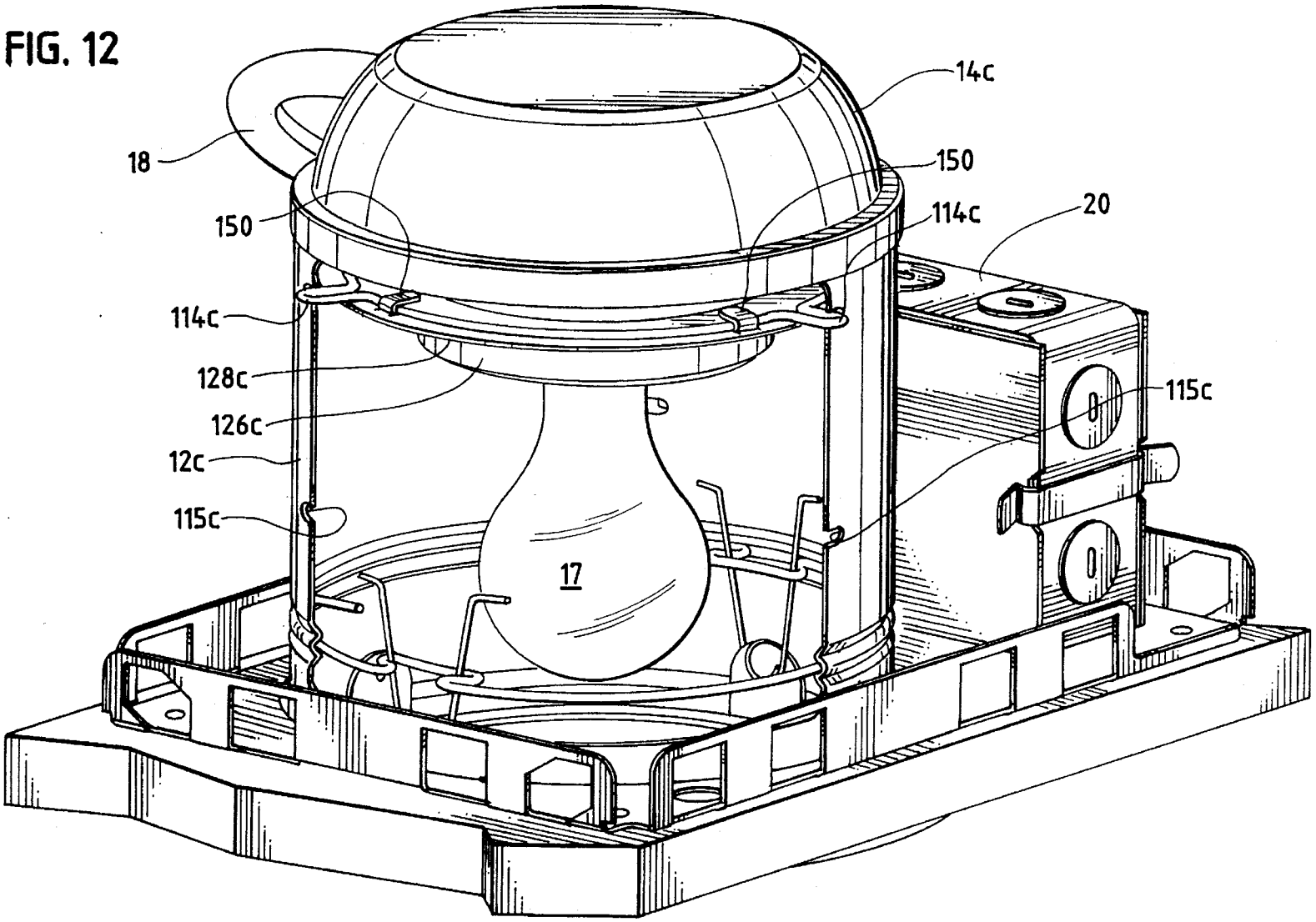
FIG. 12 is a perspective view in partial section of an assembly utilizing the spring arrangement shown in FIG. 11 adjacent the upper end of the can in this figure.

Another embodiment, shown in FIGS. 10–12, wherein similar parts bear similar numerals with the addition of the suffix "c", includes a spring 50*c* having a plurality of laterally outwardly extending elements 114*c*. The spring 50*c* is associated with a shallow cup-like member 126*c* having a laterally extending flange 128*c* with a plurality of circumferentially spaced lanced tabs 150 adapted to accept the spring 50*c* and retain same in moveable relation. This permits the handles 54*c* to be squeezed together to move the loops 114*c* inwardly to permit insertion or readjustment of the spring 50*c* relative to the housing 12*c*. This embodiment does not utilize any grooves but rather relies on the slots 115*c* arranged in planar array to locate and retain the springs 50*c*.

Figures 13, 13A, 13B, 13C, 14:
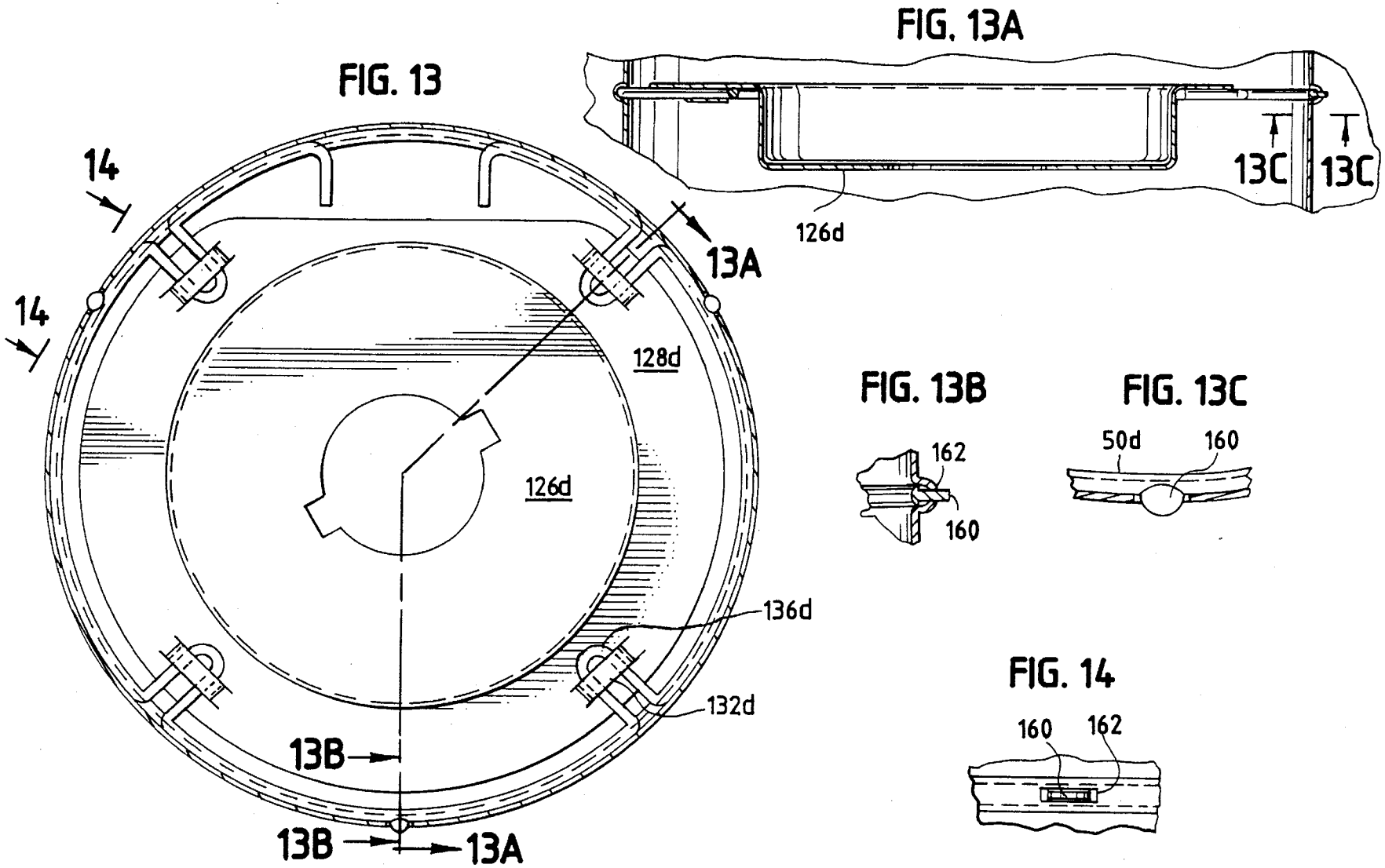
FIG. 13 is a plan view taken along line 13—13 in FIG. 15 showing still another embodiment of a spring member having inwardly directed loop members captured in a planar flange element connected to a flat cup-like member and swaged flat portions extending through slots in the bottom of the groove.
FIG. 13A is an elevational view in partial section taken along line 13A—13A of FIG.13.
FIG. 13B is a partial section taken along line 13B—13B in FIG. 13.
FIG. 13C is a partial section taken axially along line 13C—13C in FIG. 13A showing the swaged flat on the wire spring extending through the slots in the groove.
FIG. 14 is a fragmental view taken along line 14—14 of FIG. 13 showing the swaged flat on the spring extending outwardly through a slot in the groove.
Figure 15:
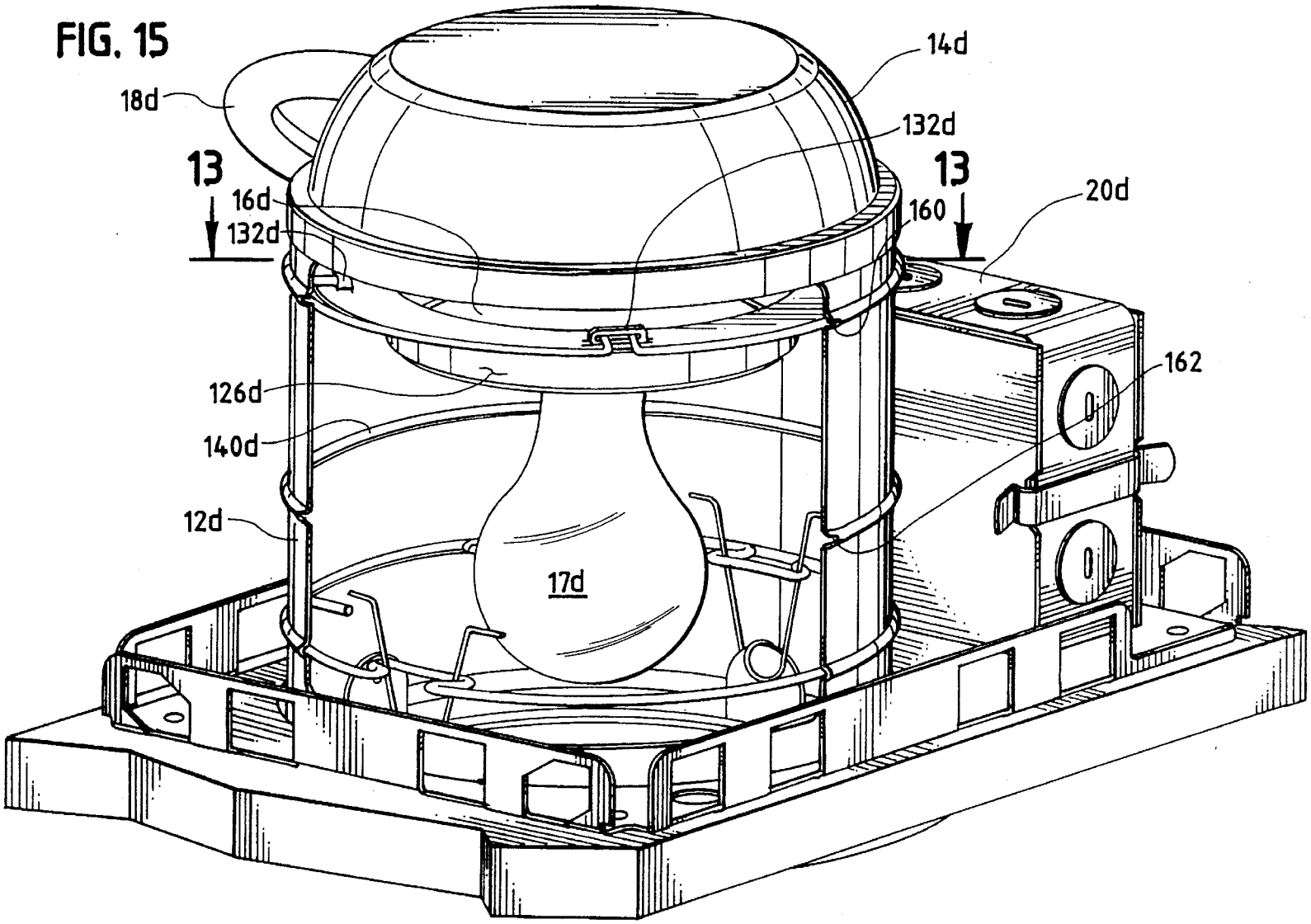
FIG. 15 is a perspective view, in partial section, showing the modified embodiment of swaged spring member disposed in the upper slotted groove, as shown in the drawing.

The embodiment shown in FIGS. 13–15 is related to the last described embodiment with similar parts designated by similar numerals with the addition of the suffix "d". In this embodiment the inventor utilizes a plurality of swaged flats 160 on the spring wire 50*d* instead of the loops 114 to engage in complimentary slots 162 located in the root of grooves 140*d*.

One advantage of the cans of the present invention is that the can does not have the vents required by the cans presently used. Such vents are normally the result of striking out support means from the wall of the can. The holes in the cans as illustrated in FIGS. 6–12 are relatively small and their area is preferrably less than 5% of the total outside area of the can.

Other embodiments will be apparent to those skilled in the art, however, it my desire to not be limited in scope except as done by the attached claims.

I claim:

1. A trim-ring auxiliary member system for capturing and supporting an auxiliary member relative to an interior and an open end of a lighting housing comprising said auxiliary member, said housing includes at least one annular groove formed in an inner wall of said housing, said annular groove axially spaced from said open end of said housing, a support spring member sized to be removably secured to said interior of said housing, said support spring member disposed within and retained by said at least one annular groove, a connecting spring removably attaching said auxiliary member to said support spring member, said support spring member including at least one bridge-like rod means extending inwardly into said housing, one end of said connecting spring connected to said rod means and another end of said connecting spring connected to said auxiliary member.

2. A trim-ring system as claimed in claim 1 wherein said at least one annular groove is disposed in planar array perpendicularly relative to an axis of said housing, said at least one bridge-like rod means comprising a pair of bridge-like rod means whereby when said support spring member is located in said annular groove, each of said rod means is disposed substantially equidistant from said open end of said housing and which provide support means for uniformly applying spring loading to said connecting spring to provide uniform pressure on said auxiliary member.

3. A trim-ring system as claimed in claim 2 wherein said connecting spring is at least one tension spring having hook-means at opposite ends thereof to fasten said at least one tension spring to said auxiliary member and one of said rod means.

4. A trim-ring system as claimed in claim 2 wherein said connecting spring is a torsion spring carried by said auxiliary member, said torsion spring having the hooked ends being captured within a void formed by said rod means and an inside wall of said housing.

5. The system of claim 1 wherein said at least one annular groove comprising a plurality of spaced annular grooves and said support spring member being axially adjustable to a plurality of positions in an easy manner without the use of tools.

6. The system of claim 5 wherein said at least one annular groove configured to accept a substantial portion of said support spring member.

7. The system of claim 1 wherein said housing is substantially cylindrical, said groove has a diameter greater than an internal diameter of said housing, a diameter of said support spring member in its relaxed state is greater than the internal diameter of said housing and at least equal to said diameter of said groove.

8. The system of claim 7 wherein said support spring member has a generally annular interrupted configuration, said at least one bridge-like rod means comprising a pair of opposed connecting spring holding means extending towards a center of said support spring member, said connecting spring holding means being integral with said support spring member, said support spring member having two free ends spaced from one another, integral handle means on each free end to forming a pair of spaced handles grippable by an operator to reduce the radial dimension of the support spring member for insertion into said housing and into at least one of said grooves and wherein release of compressive pressure on said handles resulting in an outward snapping of said spring member into retention in at least one of said grooves.

9. The system of claim 8 wherein the groove has a plurality of slots formed therethrough and said support spring member has at least one protruberence sized to fit into one of said slots.

10. The system of claim 7 wherein the groove has a plurality of slots formed therethrough and said support spring member has at least one protruberence sized to fit into one of said slots.

11. A trim-ring auxiliary member system for supporting an auxiliary member relative to an interior and open end of a substantially cylindrical lighting housing comprising, said auxiliary member, a connecting spring removably attaching said auxiliary member to said support spring member, a one-piece support spring member, said one-piece support spring member has a generally annular interrupted configuration with a pair of spaced free ends and a pair of spaced connecting spring holding means, said connecting spring holding means extending towards a radial center of said spring support member, handle means on each free end, said handle means being spaced to form a pair of spaced grippable handles that can be gripped by an operator to reduce a radial dimension of the support spring member for insertion into the interior of said lighting housing, at least a partial annular groove retaining means formed on an inner wall of said lighting housing, said groove retaining means being axially spaced from said open end of said lighting housing, said groove retaining means being sized and positioned to hold said spring support member in said lighting housing substantially perpendicular to an axis of said lighting housing wherein by exerting compressive pressure on said handles an operator can remove said spring support member from said groove retaining means.

12. The system of claim 11 wherein said groove retaining means having a diametral plan which is perpendicular to a longitudinal axis of said lighting housing.

13. The system of claim 12 wherein said at least a partial annular groove retaining means comprising a plurality of partial annular grooves formed on said lighting housing permitting said support spring member to be held in said lighting housing in more than one position.

14. The system of claim 13 wherein at least one of said at least partial annular grooves is an annular groove, said holding means is a pair of bridge-like rod means whereby when said support spring member is located in said annular groove, each of the said rod means is disposed substantially equidistant from said open end of said housing and said rod means provide means for uniformly applying spring loading to said connecting spring to provide uniform pressure on said auxiliary member.

15. The system of claim 14 wherein said connecting spring is at least one tension spring having hook-means at opposite ends thereof to fasten said at least one tension spring to said auxiliary member and one of said rod means.

16. The system of claim 14 wherein said connecting spring is a torsion spring carried by said auxiliary means, said torsion spring having hooked ends being captured within a void formed by said rod means and an inside wall of said housing.

17. The system of claim 14 wherein said groove has a diameter greater than an internal diameter of said housing, a diameter of said support spring member in its relaxed state is greater than the internal diameter of said housing and at least equal to said diameter of said annular groove whereby said support spring member is axially adjustable to a plurality of positions in an easy manner without the use of tools.

18. The system of claim 17 wherein the groove has a plurality of slots formed therethrough and said support spring member has at least one protruberence sized to fit into one of said slots.

* * * * *